US006429756B1

(12) United States Patent
Kurisu et al.

(10) Patent No.: US 6,429,756 B1
(45) Date of Patent: Aug. 6, 2002

(54) DIELECTRIC RESONATOR, FILTER, DUPLEXER, OSCILLATOR AND COMMUNICATION APPARATUS

(75) Inventors: Toru Kurisu; Hirotsugu Abe; Yukio Higuchi, all of Omihachiman (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/578,045

(22) Filed: May 24, 2000

(30) Foreign Application Priority Data

May 25, 1999 (JP) ..... 11-144980

(51) Int. Cl.[7] ..... H01P 7/10
(52) U.S. Cl. ..... 333/219.1; 333/134
(58) Field of Search ..... 333/219.1, 227, 333/206, 229, 234, 134

(56) References Cited

U.S. PATENT DOCUMENTS

| | | | | |
|---|---|---|---|---|
| 4,307,352 A | * | 12/1981 | Shinkawa et al. | 331/99 |
| 4,996,506 A | * | 2/1991 | Ishikawa et al. | 333/219.1 |
| 5,179,074 A | * | 1/1993 | Fiedziuszko et al. | 505/210 |
| 5,200,721 A | * | 4/1993 | Mansour | 333/202 |
| 5,754,083 A | * | 5/1998 | Abe et al. | 333/219.1 |

FOREIGN PATENT DOCUMENTS

| | | | | |
|---|---|---|---|---|
| EP | 0399770 | | 11/1990 | H01P/7/10 |
| EP | 0465059 | | 1/1992 | H01P/7/10 |
| EP | 0789417 | | 8/1997 | H01P/7/10 |
| JP | 7135411 | | 5/1995 | H01P/7/10 |
| JP | 7154116 A | * | 6/1995 | H01P/7/10 |
| JP | 8222917 | | 8/1996 | H01P/7/10 |

OTHER PUBLICATIONS

Nishikawa, Y. et al., 1992, Microwave Symposium Digest, IEEE MTT–S International, vol. 3, pp. 1617–1620.*
European Search Report dated Jul. 28, 2000, Application No. EP 00 11 0696.

* cited by examiner

*Primary Examiner*—Robert Pascal
*Assistant Examiner*—Dean Takaoka
(74) *Attorney, Agent, or Firm*—Ostrolenk, Faber, Gerb & Soffen, LLP

(57) ABSTRACT

A dielectric resonator comprising a resonator section and a supporting base section which are made of the same dielectric material as a single unit. The resonator section and the supporting base section have substantially the same outside diameter. A concave section having a trapezoidal cross-sectional shape is provided within the supporting base section such that the inside diameter of the supporting base section becomes smaller in the direction from the end face, which is used as a mounting face, and toward the resonator section.

24 Claims, 4 Drawing Sheets

DIELECTRIC RESONATOR, FILTER, DUPLEXER, OSCILLATOR AND COMMUNICATION APPARATUS

BACKGROUND OF THE INVENTION

1. Field of the Invention

The present invention relates to a TE01δ-mode dielectric resonator having a resonator section and a supporting base section which are made of the same dielectric material as a single unit; a filter, a duplexer, and an oscillator each using the dielectric resonator; and a communication apparatus using the above.

2. Description of the Related Art

Generally, dielectric resonators of the aforementioned type have a structure in which a supporting base having a low dielectric constant is adhered to a resonator section having a high dielectric constant. In this case, however, a problem is that adhering work for the supporting base section is required, and manufacturing costs are increased thereby.

In this situation, there is proposed a dielectric resonator having a resonator section and a supporting base section that are formed of the same dielectric material as a single unit (Japanese Unexamined Patent Application Publication No. 8-222917). In the dielectric resonator according to Japanese Unexamined Patent Application Publication No. 8-222917, the supporting base section is formed in the shape of a cylinder with an outside diameter smaller than that of the resonator section. A radial slit is provided in the supporting base section, a groove is provided in an outer peripheral face, and a through-hole is provided in the diameter direction to eliminate a part of the supporting base section, thereby reducing the effective dielectric constant of the supporting base section so as to minimize reduction in the unloaded Q value. Thus, to prevent the reduction in the unloaded Q value of the TE01δ-mode dielectric resonator that includes the supporting base, formed as a single unit, it is important to reduce the amount of dielectric in the supporting base section, thereby reducing the dielectric constant of the supporting base section.

The dielectric resonator as described above is immobilized with an adhesive or the like onto either a substrate or a bottom wall of a cavity so that the bottom end face of the supporting base section is used as a mounting face. It is used either in a filter or a transmitting device.

In the above-described conventional single unit dielectric resonator that includes the supporting base, however, there is a right-angled step portion at the border between the resonator section and the supporting base section. Since the border area is not pressed evenly during press forming, the formation density (the density of the formed body) sharply varies at the border area. Also, since the shape of the supporting base section is complicated, problems are raised in that stable formation is impossible, and formation using a uniaxial pressuring press is difficult or impossible. Other problems are raised by the complicated shape of the forming die. Therefore, manufacturing costs therefor are high, and the service life thereof is short.

Also, in the above-described dielectric resonator, since the outside diameter of the supporting base section is smaller than that of the resonator section, problems are raised in that the dielectric resonator cannot be stably mounted in a cavity by automatic mounting.

SUMMARY OF THE INVENTION

To overcome the above described problems, embodiments of the present invention provide a dielectric resonator that is cheap, that has good characteristics, that allows the unloaded Q value to be minimized, that can be easily formed, and that can be stably mounted; and a filter, a duplexer, an oscillator, and a communication apparatus that use the dielectric resonator.

One embodiment of the present invention provides a dielectric resonator comprising a resonator section and a supporting base section which are made of the same dielectric material as a single unit; wherein said resonator section and said supporting base section have substantially the same outside diameter; a concave section the cross section of which is a trapezoidal shape is provided within said supporting base section such that the inside diameter of said supporting base section is generally tapered from the end face, which is used as a mounting face, in the direction toward said resonator section.

Of course, the cross section of the concave portion need not be precisely trapezoidal. Skilled persons will appreciate that other generally tapered cross-sectional shapes are usable as well.

According to the above structure and arrangement, the mounting face of the supporting base section is ring-shaped, and the width thereof (in other words, the thickness of the dielectric constituting the supporting base section) is reduced. Therefore, the effective dielectric constant of the supporting base section is significantly reduced. This minimizes reduction in the unloaded Q value of the resonator.

Further, the dielectric resonator has a simple shape, since only the above-mentioned concave trapezoidal cross section is formed in the supporting base section, and no right-angled step section is formed. Therefore, sharp variations in the formation density of the formed body are substantially avoided. Therefore, the dielectric resonator does not become deformed and reduced in mechanical strength and can be easily formed by the use of a low-cost forming method using a uniaxial-pressuring press. Starting with the reduced width of the ring shape at the mounting face of the supporting base section, the thickness of the dielectric constituting the supporting base section becomes greater in the direction toward the resonator section. This prevents reduction in the mechanical strength of the formed body.

Also, since the outside diameter of the supporting base section is the same as that of the resonator section, the dielectric resonator can be stably mounted.

In the above described dielectric resonator, a through-hole may be provided in a central portion of the resonator section and continuing into the concave section. This arrangement is particularly applicable when the dielectric resonator is immobilized within a cavity with an adhesive. Air that is hermetically enclosed in the concave section can expand due to high temperatures that occur in the curing process. This trapped air can cause positional deviations after adhesion. This problem is avoided by providing the hole in the resonator section.

Further, a filter, a duplexer, and an oscillator may be provided with the above described dielectric resonator. Thereby, manufacturing costs can be reduced, and good characteristics thereof can be obtained.

Further, a communication apparatus may be provided with one of the above described filter, duplexer, and oscillator. Thereby, a communication apparatus with a good characteristics can be obtained cheaply.

Other features and advantages of the present invention will become apparent from the following description of embodiments of the invention which refers to the accompanying drawings.

DESCRIPTION OF EMBODIMENTS OF THE INVENTION

Figure 1:
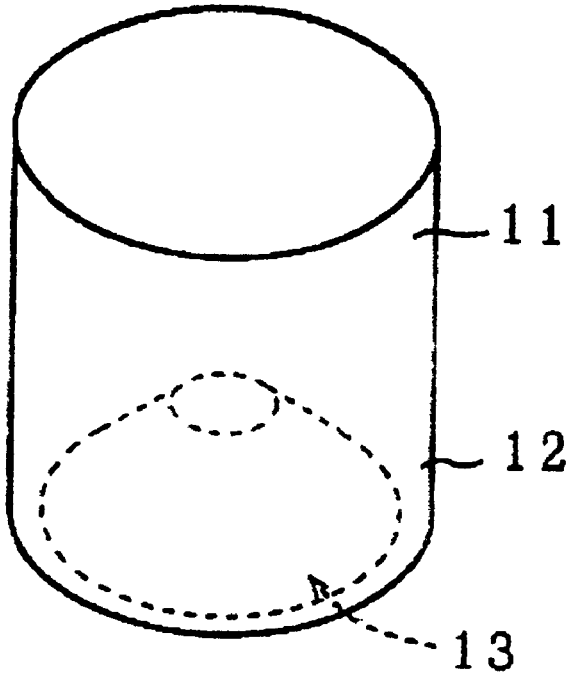
FIG. 1 is a perspective view of a dielectric resonator according to a first embodiment of the present invention.
Figure 2:
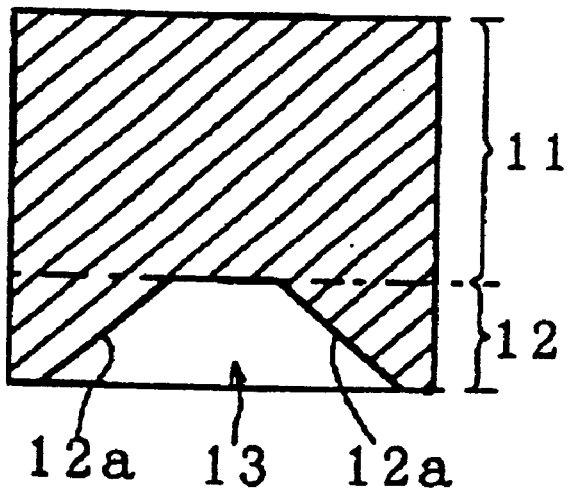
FIG. 2 is a cross-sectional view of the dielectric resonator according to the first embodiment of the present invention.

Referring to FIGS. 1 and 2, a description will be given of the arrangement of a dielectric resonator according to a first embodiment of the present invention. FIG. 1 is a perspective view of a dielectric resonator, and FIG. 2 is a cross-sectional view thereof.

The dielectric resonator of this embodiment is configured of a substantially cylindrical dielectric body, in which a resonator section 11 and a supporting base section 12 are formed as a single unit. The supporting base section 12 is formed to have the same outside diameter as that of the resonator section 11. A concave section 13 with a trapezoidal cross sectional shape is formed in the supporting base section 12. That is, the inside diameter decreases so that the concave section 13 is tapered in the direction from the end face, used as a mounting face, toward the resonator section 11, and the outer peripheral portion of the end face is ring-shaped.

Specifically, the concave section 13 is coaxial with respect to the central axis of the dielectric resonator. After formation of the concave section 13, the outer peripheral section of the supporting base section 12 is ring-shaped, and its thickness increases in the direction toward the resonator section 11. A taper 12*a* is provided on the inner peripheral face of the concave section 13. The dielectric resonator is integrally formed using a uniaxial-pressuring press and a metal die. In the dielectric resonator thus formed, the end face of the supporting base section 12 is used as a mounting face and is immobilized with an adhesive or the like on the bottom wall of either a substrate or a cavity. The resonator section 11 is designed to resonate in a TE01δ mode in the cavity so as to be usable for example in a filter or a transmitting device.

As described above, the concave section 13 is formed with a trapezoidal cross section. In this case, the dielectric material in the supporting base section 12 can be significantly reduced without reducing its mechanical strength, thereby allowing the effective dielectric constant to be reduced and maintaining a high unloaded Q value. Therefore, a dielectric resonator having good attenuation characteristics with small insertion loss can be obtained.

The dielectric resonator of this embodiment has a simple shape. Only the concave section 13, having a trapezoidal cross sectional shape, is formed in the supporting base section 12, and no right-angled step section is formed. Therefore, sharp variations in the formation density, which can be caused in a formed body, are significantly reduced. Accordingly, the dielectric resonator is not weakened so as to become deformed and reduced in mechanical strength. Also, since the outside diameter of the supporting base section 12 is the same as that of the resonator section 11, mounting can be stably performed.

Figure 3:
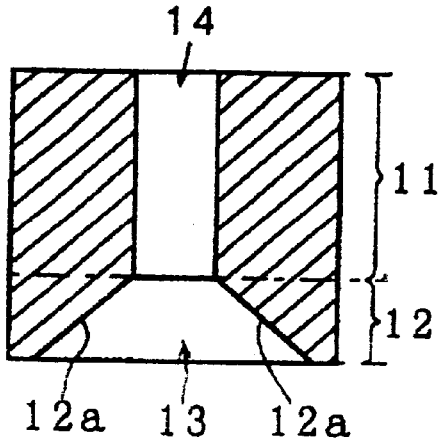
FIG. 3 is a cross-sectional view of a dielectric resonator according to a second embodiment of the present invention.

Next, a dielectric resonator of a second embodiment according to the present invention is shown in FIG. 3. A central through-hole 14 passes from the end face of the resonator section 11 and into the supporting base section 12. Other aspects in the arrangement are the same as those of the dielectric resonator of the first embodiment shown in FIGS. 1 and 2.

According to the above arrangement, air can be prevented from being hermetically enclosed in the concave section 13 when the dielectric resonator is immobilized with an adhesive within a cavity. Such trapped air can expand due to a high temperature occurring in the curing process. By preventing the trapped air, this embodiment of the invention can prevent positional deviations that can occur in the adhesion process.

Figure 4:
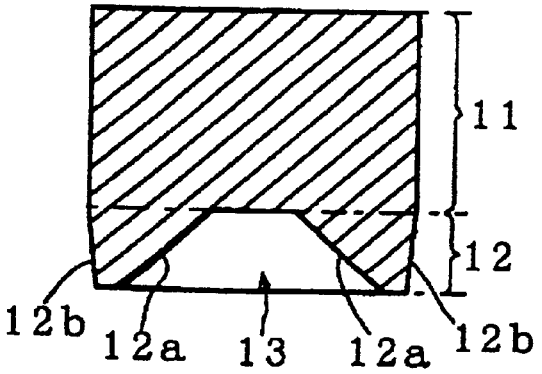
FIG. 4 is a cross-sectional view of a dielectric resonator according to a third embodiment of the present invention.

Next, a dielectric resonator of a third embodiment according to the present invention is shown in FIG. 4. In the dielectric resonator shown in FIG. 4, a taper 12*b* is provided on the outer peripheral face of a supporting base section 12, such that the outside diameter decreases from the border with the resonator section 11 in the direction toward the mounting face. No step portion is provided at the border between the resonator section 11 and the supporting base section 12. Other aspects of the arrangement are the same as those of the first embodiment shown in FIGS. 1 and 2. Thus, the effective dielectric constant may be reduced by eliminating a part of the outer peripheral face of the supporting base section 12.

Figure 5:
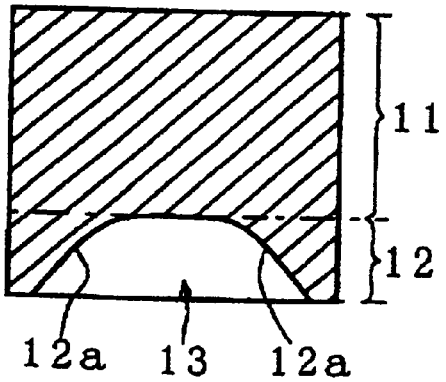
FIG. 5 is a cross-sectional view of a dielectric resonator according to a fourth embodiment of the present invention.

Next, a dielectric resonator of a fourth embodiment according to the present invention is shown in FIG. 5. In the first to third embodiments, the cross-sectional shape of the concave section 13 provided in the supporting base section 12 is linear; however, in the dielectric resonator of this embodiment, the concave section 13 has a partially or completely curvilinear cross-section. This arrangement allows variations in the formation density of the dielectric material to be further reduced.

In each of the above embodiments, the respective dielectric resonators are circular in their horizontal cross-sectional shape; however, the shape is not restricted thereto. The horizontal cross-sectional shape may instead be different, such as rectangular or elliptical.

Likewise, the horizontal cross-sectional shape of the concave portion 13 need not be circular as in the above embodiments, but other shapes are usable as well.

Hereinbelow, a description will be given of examples of a filter, a duplexer, and a resonator each of which is provided with the dielectric resonator of the present invention. In the embodiments described below, the dielectric resonator according to any one of the above-described embodiments may be used.

Figure 6:
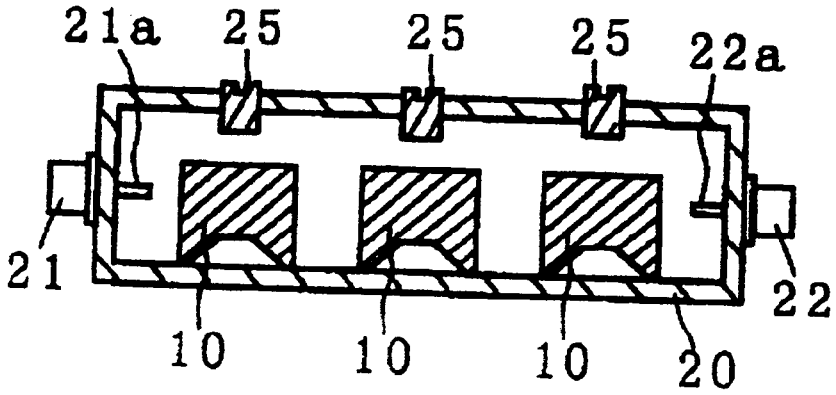
FIG. 6 is a cross-sectional view of a filter according to a fifth embodiment of the present invention.

Hereinbelow, referring to FIG. 6, a description will be given of a filter according to a fifth embodiment of the present invention. The filter of this embodiment is configured such that three dielectric resonators 10 are provided in a cavity 20 that has coaxial connectors 21 and 22 installed at both ends as input/output connectors. In the coaxial connectors 21 and 22, probes 21*a* and 22*a* are provided so as to electromagnetically couple with the corresponding dielectric resonators 10. Each of the dielectric resonators 10 is immobilized such that the mounting face of the supporting base section 12 is adhered with an adhesive or the like onto the bottom wall of the cavity 20. Also, screws 25 for adjusting frequency are provided above the dielectric resonators 10. The cavity 20 is a conductive housing that has either a metal surface, or a ceramic surface on which conductors are formed. The number of dielectric resonators is not restricted to three. One, two, or more than three dielectric resonators may be used.

Figure 7:
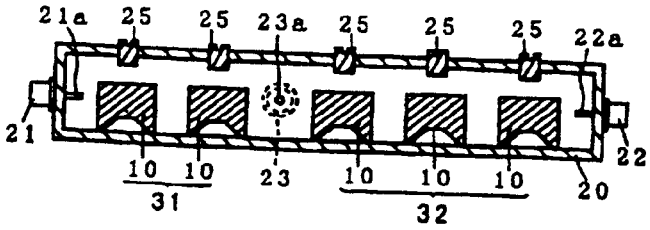
FIG. 7 is a cross-sectional view of a duplexer according to a sixth embodiment of the present invention.

Hereinbelow, referring to FIG. 7, a description will be given of a duplexer according to a sixth embodiment of the present invention. The duplexer of this embodiment has a cavity 20 for containing two dielectric resonators 10 that compose a transmitting filter 31, and three dielectric resonators that compose a receiving filter 32. As an input/output connector for the transmitting filter, a coaxial connector 21 is provided on one end of the cavity 20. As an input/output connector for the receiving filter, a coaxial connector 22 is provided on the other end thereof. Also, as an antenna input/output connector commonly coupled with both the transmitting and receiving filters, a coaxial connector 23 is provided on a central portion of the sidewall of the cavity 20. The coaxial connectors 21, 22, and 23 have probes 21*a*, 22*a*, and 23*a*, respectively, provided for electromagnetically coupling with the corresponding dielectric resonators 10. Each of the individual dielectric resonators 10 is immobilized such that the mounting face of the supporting base section 12 is adhered with an adhesive or the like onto the bottom wall of the cavity 20. Also, screws 25 for adjusting frequency are provided above the dielectric resonators 10.

Figure 8:
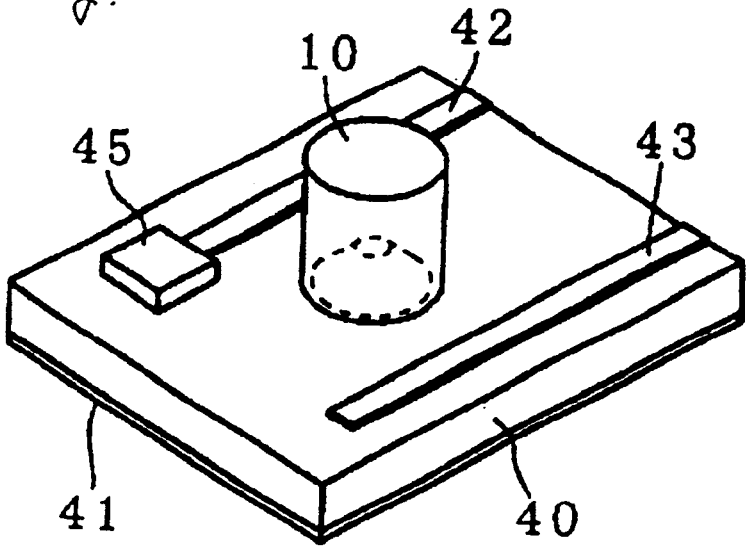
FIG. 8 is a perspective view of an oscillator according to a seventh embodiment of the present invention.

Hereinbelow, referring to FIG. 8, a description will be given of an oscillator according to a seventh embodiment of the present invention. The oscillator of this embodiment is configured such that the dielectric resonator 10, a first microstrip line 42 for electromagnetically coupling with the dielectric resonator 10, a second microstrip line 43, and an exciting positive element 45 connected to the first microstrip line 42 are provided on the front surface of a dielectric substrate 40 that has a grounding electrode 41 on the reverse surface. For the exciting positive element 45, a field effect transistor or the like is used. The dielectric resonator 10 is immobilized such that the mounting face of the supporting base section 12 is adhered onto the dielectric substrate 40 with an adhesive or the like. The oscillator is contained in a cavity (not shown), or a metal housing that functions as a cavity is installed so as to cover the dielectric substrate 40.

Figure 9:
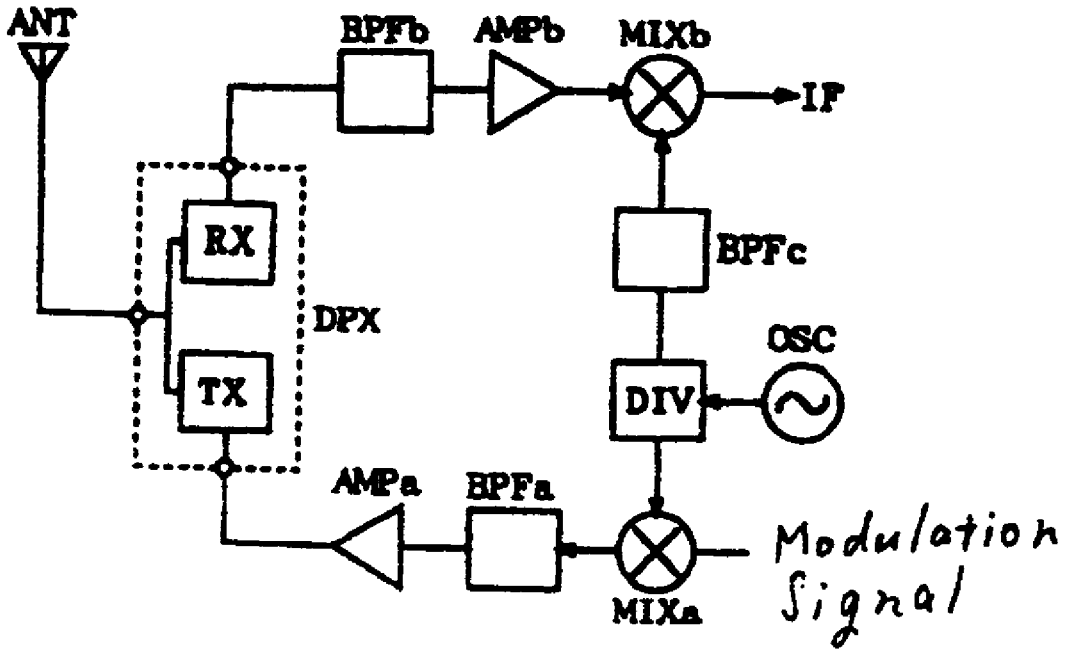
FIG. 9 is a block diagram of a communication apparatus according to an eighth embodiment of the present invention.

Hereinbelow, the arrangement of a communication apparatus according to an eighth embodiment of the present invention is shown in FIG. 9. In FIG. 9, ANT denotes a transmitting/receiving antenna; DPX denotes a duplexer, TX denotes a transmitting filter; RX denotes a receiving filter; BPFa, BPFb, and BPFc individually denote bandpass filters; AMPa and AMPb individually denote amplifier circuits; MIXa and MIXb individually denote mixers; OSC denotes an oscillator; and DIV denotes a frequency divider (synthesizer). MIXa uses a modulation signal to modulate a signal outputted from DIV, BPFa allows only a signal in the transmitting-frequency band to pass through, and AMPa power-amplifies the signal and transmits it from ANT via DPX (TX). BPFb allows only a signal outputted from DPX (RX) in the receiving-frequency band to pass through, and AMPb amplifies it. MIXb mixes a frequency signal and a received signal that are outputted from BPFc, thereby outputting an intermediate frequency signal.

Here, as the transmitting filter TX, the receiving filter RX, and the bandpass filters BPFa, BPFb, and BPFc, the filter of the fifth embodiment may be used. Also, as the duplexer DPX, the duplexer of the sixth embodiment may be used. In addition, as the oscillator OSC, the oscillator of the seventh embodiment may be used. Using the filter, the duplexer, or the oscillator realizes a cheap communication apparatus that has good characteristics.

While the invention has been particularly shown and described with reference to preferred embodiments thereof, it will be understood by those skilled in the art that the foregoing and other changes in form and details may be made therein without departing from the spirit of the invention.

What is claimed is:

1. A dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section; and wherein said end face provides a mounting face of said dielectric resonator.

2. The dielectric resonator according to claim 1, wherein said vertical cross-sectional shape is substantially trapezoidal.

3. The dielectric resonator according to claim 1, wherein said vertical cross-sectional shape is at least partly curvilinear.

4. The dielectric resonator according to claim 1, wherein said concave surface has a horizontal cross-sectional shape which is substantially circular.

5. The dielectric resonator according to claim 1, further comprising a through-hole extending through said resonator section and communicating with said concave surface.

6. The dielectric resonator according to claim 5, wherein said through-hole passes through a central portion of said resonator section from said concave surface to a top face of said resonator section which is remote from said supporting base section.

7. The dielectric resonator according to claim 1, wherein said outside shape is substantially cylindrical.

8. The dielectric resonator according to claim 1, wherein an outside surface of said supporting base is tapered.

9. A filter comprising:

a dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section; and wherein said end face provides a mounting face of said dielectric resonator;

a cavity containing said dielectric resonator; and an input/output connector disposed on said cavity for being electromagnetically coupled with said dielectric resonator.

10. The filter according to claim 9, wherein said dielectric resonator further comprises a through-hole extending through said resonator section and communicating with said concave surface.

11. The filter according to claim 9, wherein said end face is disposed on an inside surface of said cavity.

12. The filter according to claim 9, wherein said end face is disposed on a substrate associated with said cavity.

13. A duplexer comprising:

a transmitting filter and a receiving filter, each of said filters comprising:

a dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section; and said dielectric resonator being mounted in a cavity, said cavity having:

a first input/output connector disposed for being coupled with the dielectric resonator of said transmitting filter;

a second input/output connector disposed for being coupled with the dielectric resonator of said receiving filter; and an antenna input/output connector disposed for being coupled with respective dielectric resonators of both said transmitting filter and said receiving filter.

14. The duplexer according to claim 13, wherein each said dielectric resonator further comprises a through-hole extending through said resonator section and communicating with said concave surface.

15. An oscillator comprising:

a dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section;

a coupling device disposed for being electromagnetically coupled with said dielectric resonator;

an exciting element connected to said coupling device; and a cavity containing said dielectric resonator, said coupling device and said exciting element.

16. The oscillator according to claim 15, wherein said dielectric resonator further comprises a through-hole extending through said resonator section and communicating with said concave surface.

17. A communication apparatus comprising:

a high-frequency circuit comprising at least one of a transmitting circuit and a receiving circuit; and connected to said high-frequency circuit, a filter comprising:

a dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section;

a cavity containing said dielectric resonator; and an input/output connector disposed on said cavity for being electromagnetically coupled with said dielectric resonator.

18. The communication device according to claim 17, wherein said dielectric resonator further comprises a through-hole extending through said resonator section and communicating with said concave surface.

19. A communication apparatus comprising:

a high-frequency circuit comprising at least one of a transmitting circuit and a receiving circuit; and a duplexer comprising:

a transmitting filter and a receiving filter, each of said filters comprising:

a dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section; and said dielectric resonator being mounted in a cavity, said cavity having:

a first input/output connector disposed for being coupled with the dielectric resonator of said transmitting filter;

a second input/output connector disposed for being coupled with the dielectric resonator of said receiving filter; and an antenna input/output connector disposed for being coupled with respective dielectric resonators of both said transmitting filter and said receiving filter at least one of said first and second input/output connectors being connected to said high-frequency circuit.

20. The communication device according to claim 19, wherein each said dielectric resonator further comprises a through-hole extending through said resonator section and communicating with said concave surface.

21. A communication apparatus comprising:

a high-frequency circuit comprising at least one of a transmitting circuit and a receiving circuit; and connected to said high-frequency circuit, an oscillator comprising:

a dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section;

a coupling device disposed for being electromagnetically coupled with said dielectric resonator;

an exciting element connected to said coupling device; and a cavity containing said dielectric resonator, said coupling device and said exciting element.

22. The oscillator according to claim 21, wherein said dielectric resonator further comprises a through-hole extending through said resonator section and communicating with said concave surface.

23. A communication device comprising:

a transmitting circuit and a receiving circuit; and a duplexer comprising:

a transmitting filter and a receiving filter, each of said filters comprising:

a dielectric resonator comprising a resonator section and a supporting base section which are made of the same dielectric material as a single unit;

wherein said resonator section and said supporting base section have substantially the same outside shape;

wherein a non-conductive concave surface is formed within said supporting base section, the concave surface having a tapered vertical cross-sectional shape such that an inside diameter of said supporting base section is reduced from a widest part at an end face disposed away from said resonator section, to a narrowest part adjacent to said resonator section; and said dielectric resonator being mounted in a cavity, said cavity having:

a first input/output connector disposed for being coupled with the dielectric resonator of said transmitting filter, said first input/output connector being connected to said transmitting circuit;

a second input/output connector disposed for being coupled with the dielectric resonator of said receiving filter, said second input/output connector being connected to said receiving circuit; and an antenna input/output connector disposed for being coupled with respective dielectric resonators of both said transmitting filter and said receiving filter.

24. The communication device according to claim 23, wherein each said dielectric resonator further comprises a through-hole extending through said resonator section and communicating with said concave surface.

* * * * *